United States Patent [19]

Wilson

[11] 4,238,652

[45] Dec. 9, 1980

[54] SWITCH SYSTEM FOR INDICATING CHANGES IN LIQUID LEVEL

[75] Inventor: Nelson H. Wilson, Brownsburg, Ind.

[73] Assignee: Indian Head, Inc., New York, N.Y.

[21] Appl. No.: 956,105

[22] Filed: Oct. 30, 1978

[51] Int. Cl.[3] ..... H01H 35/18

[52] U.S. Cl. ..... 200/84 B; 200/61.2; 340/623

[58] Field of Search ..... 200/61.2–61.26, 200/84 B, 83 R, 83 B, 83 L, 81.4; 340/623, 614, 618, 626; 307/118

[56] References Cited

U.S. PATENT DOCUMENTS

| | | | |
|---|---|---|---|
| 2,843,144 | 8/1958 | Robinson et al. | 340/614 |
| 2,961,508 | 11/1960 | Minneci et al. | 200/83 R |
| 3,543,580 | 12/1970 | McGill | 73/313 |
| 3,657,501 | 4/1972 | Hoyt | 200/81.4 |

*Primary Examiner*—J. V. Truhe
*Assistant Examiner*—Morris Ginsburg
*Attorney, Agent, or Firm*—Lyon & Lyon

[57] ABSTRACT

This invention relates to an improved method and apparatus for detecting the level of a first fluid. It includes a reservoir within the first fluid, the reservoir being bounded by a flexible membrane at its lower portion for containing a second fluid. The reservoir contains at least one switching means biased to assume a first position when the second fluid is below a predetermined level and adapted to assume a second position upon the rising of the first fluid into pressure exerting contact with the flexible membrane. The rising first fluid compresses the lower flexible membrane portion of the reservoir and causes the second fluid within the reservoir to also rise thereby causing the switching means to assume the second position.

8 Claims, 1 Drawing Figure

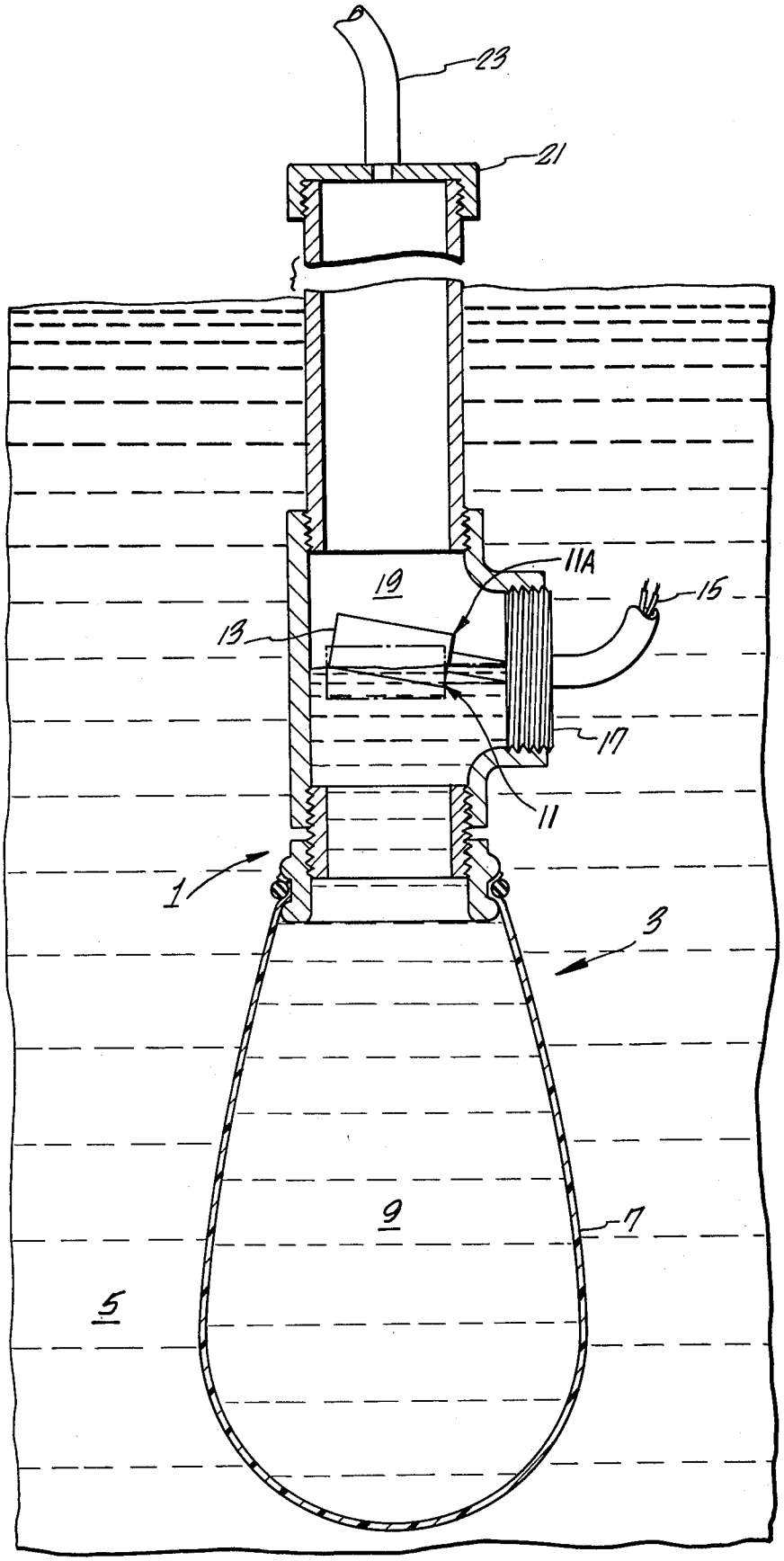
23
21
19
11A
15
13
17
11
1
3
9
7
5

SWITCH SYSTEM FOR INDICATING CHANGES IN LIQUID LEVEL

BACKGROUND OF THE INVENTION

The invention relates to an improved system for a switching means activated by a fluid level.

FIELD OF THE INVENTION

The present invention pertains generally to an improved switch system for detecting a level of contaminated fluid.

DESCRIPTION OF THE PRIOR ART

The level of fluids has previously been determined and measured by level actuated switches located directly in the liquid or fluid to be measured. The chief disadvantage of such an application is that when the fluid to be measured contains contaminants, such contaminants foul and/or corrode the switching means utilized to measure the fluid level. Additionally, such switches are often damaged by floating debris, or, by contact with the container holding the contaminated fluid, particularly when the fluid enters the container at high flow rates. Such devices require periodic maintenance and washing of the switch locations.

SUMMARY OF THE INVENTION

This invention relates to an improved method and apparatus for detecting the level of a first fluid. It includes a reservoir within the first fluid,, the reservoir being bounded by a flexible membrane at its lower portion for containing a second fluid. The reservoir contains at least one switching means biased to assume a first position when the second fluid is below a predetermined level and adapted to assume a second position upon the rising of the first fluid into pressure exerting contact with the flexible membrane. The rising first fluid compresses the lower flexible membrane portion of the reservoir and causes the second fluid within the reservoir to also rise thereby causing the switching means to assume the second position.

BRIEF DESCRIPTION OF THE DRAWING

The FIGURE is a pictorial view illustrating the present invention.

DESCRIPTION OF PREFERRED EMBODIMENTS

Referring to FIG. 1, a switching system, generally referred to as 1, is illustrated. The switching system 1 includes a reservoir, generally referred to as 3, suspended above or within a first fluid 5 and containing a second fluid 9. The lower portion of the reservoir 3 is defined by a flexible impermeable membrane 7. Membrane 7 separates the second fluid 9 from the first fluid 5.

The reservoir 3 also contains switching means assembly, generally referred to as 11. The switching means assembly 11 preferably includes a mercury tilt switch 13 connected to communicative switch wire 15. The switch wire 15 may be secured through an aperture in the reservoir 3 by means of a closure plug 17. That portion of the reservoir 3 containing switch 13 includes a reservoir switching zone 19 within which said switch 13 is adapted to assume either a first or second predetermined position based upon the fluid level within the reservoir 3 of the second fluid 9.

In certain embodiments a plurality of switching means 11 may be employed. In order that the signal transmitted by switch wire 15 is not improperly influenced by momentary fluid level changes, a second switching means 11A assembly may be employed above that shown in the FIGURE, such that both switching means assemblies 11 and 11A must be activated by raising (and deactivated by lowering) second fluid 9. Further, third and fourth switching means might also be employed at other elevations within the switching zone 19 for other purposes such as activation of auxiliary pumping facilities or high or low level alarms.

Preferably, the reservoir 3 is provided with a cap 21 and a vent means 23 in order to allow for the escape of vapors within the reservoir upon the rising of the second fluid 9 within the reservoir 3.

The apparatus of this invention having been described, its method of operation will now be discussed.

When the level of the first fluid 5 rises, the first fluid 5 comes in contact with a flexible membrane 7 and compresses the membrane 7 inwardly, thereby displacing the second fluid 9, driving it into and also raising its level within the reservoir 3. The switch 13 is adapted to assume a first position when the second fluid 9 has not risen within the switching zone 19 to a level to require the switch to assume a second predetermined position (shown dotted in the FIGURE). This change in position in switch 13 is in turn transmitted by appropriate switch wire 15. In those embodiments where the first fluid 5 is a contaminated fluid, the method and apparatus in this invention provide for a system wherein the contaiminated fluid does not contact the switching means 11.

While the particular switch system herein shown and described in detail is fully capable of obtaining the advantages herein stated, it is understood that it is merely illustrative of the presently preferred embodiment of the invention and that no limitations are intended to be applied to the details of construction or design herein shown other than as defined in the appended claims which form a part of this disclosure.

What is claimed is:

1. An improved method for detecting a change in liquid level of a first liquid comprising:

containing a second liquid within a reservoir;

biasing a switching means to assume a first position when said second liquid is below a predetermined level; and compressing a flexible membrane lower portion of said resevoir upon pressure exerting contact with the rising of said first liquid level thereby raising the liquid level of said second liquid and urging said switching means to assume a second position.

2. The method claimed in claim 1 further comprising: continuously venting vapor from said reservoir.

3. An improved method for detecting a change in liquid level of contaminated liquid comprising:

containing a noncontaminated liquid within a reservoir;

biasing a switching means to assume a first position when said noncontaminated liquid is below a predetermined level; and compressing a flexible membrane lower portion of said reservoir upon pressure exerting contact with a rising contaminated liquid level thereby raising the liquid level of said noncontaminated liquid and urging said switching means to assume a second position.

4. The method claimed in claim 3 further comprising: continuously venting vapors from said reservoir.

5. An improved switch system for detecting a change in liquid level of a first liquid comprising:

a reservoir means for containing a second liquid at a predetermined level and preventing entrance of a said first liquid;

said reservoir means including a flexible impermeable membrane forming the lower portion of said reservoir and a switching zone above said membrane; and two switch means positioned within said reservoir means switching zone, one above the other, each switch means being adapted to assume a first or second predetermined position, each of said switch means assuming said first position when said second liquid level is below a predetermined level and said second position when said second liquid level is above said predetermined level whereby a first liquid level rising into pressure exerting contact with said membrane causes said second fluid liquid level also rise so as to cause each of said switch means to assume said second predetermined position within said reservoir means.

6. The switch system claimed in claim 5 further comprising:

a vent means open to and communicating with, and positioned above, the upper portion of said reservoir means for venting vapors therefrom.

7. An improved switch system for detecting a change in liquid level of a contaminated liquid comprising:

a reservoir means for containing a noncontaminated liquid of a predetermined level and preventing entrance of said contaminated liquid;

said reservoir means including a flexible impermeable membrane forming the lower portion of said reservoir means and a switching zone above said membrane; and a switch means positioned within said reservoir means switching zone, said switch means being adapted to assume a first or second predetermined position, said switch means assuming said first position when said noncontaminated liquid level is below a predetermined level and said second position when said noncontaminated liquid level is above said predetermined level whereby a contaminated liquid level rising into pressure exerting contact with said membrane causes said noncontaminated liquid level to also rise so as to cause said switch means to assume said second predetermined position within said reservoir means.

8. The switch system claimed in claim 7 further comprising:

a vent means communicating with,, and positioned above, the upper portion of said reservoir means for continuously venting vapors therefrom.

* * * * *